United States Patent [19]

Cavanagh

[11] Patent Number: 4,575,081

[45] Date of Patent: Mar. 11, 1986

[54] TENNIS BALL RETRIEVING SYSTEM

[76] Inventor: Peter A. Cavanagh, Pole 29 1/2, West Greenville Rd., Greenville, R.I. 02828

[21] Appl. No.: 653,195

[22] Filed: Sep. 24, 1984

[51] Int. Cl.[4] ..... A63B 61/00

[52] U.S. Cl. ..... 273/29 A; 198/676; 273/395

[58] Field of Search ..... 273/29 A, 30, 26 R, 273/26 D, 176 E, 176 G, 176 H, 201, 49, 395, 396; 198/676; 124/45, 48, 51 R, 82

[56] References Cited

U.S. PATENT DOCUMENTS

| | | | |
|---|---|---|---|
| 1,931,841 | 10/1933 | Evans | 273/201 |
| 2,397,305 | 3/1946 | Wheat | 198/676 |
| 3,232,612 | 2/1966 | Bessinger | 273/49 |
| 3,825,259 | 7/1974 | Burchett | 273/29 A |
| 4,025,071 | 5/1977 | Hodges | 273/29 A |
| 4,074,905 | 2/1978 | High | 273/26 D |
| 4,243,221 | 1/1981 | Godinho | 273/29 A |
| 4,456,252 | 6/1984 | Hartland | 273/29 A |

*Primary Examiner*—Richard C. Pinkham
*Assistant Examiner*—T. Brown
*Attorney, Agent, or Firm*—Barlow & Barlow, Ltd.

[57] ABSTRACT

A tennis ball recovery system for use in a full court utilizes an inelastic flexible damping screen hooked onto the back fence of the tennis court, which intercepts the driven ball and drops it onto a resilient apron that extends away from a collection trough. Within the trough there is located a conveyor that will move the balls toward the center of the trough and substantially central of the trough a conduit is provided with positive pressure to move the ball into a conduit and into a receptacle.

3 Claims, 6 Drawing Figures

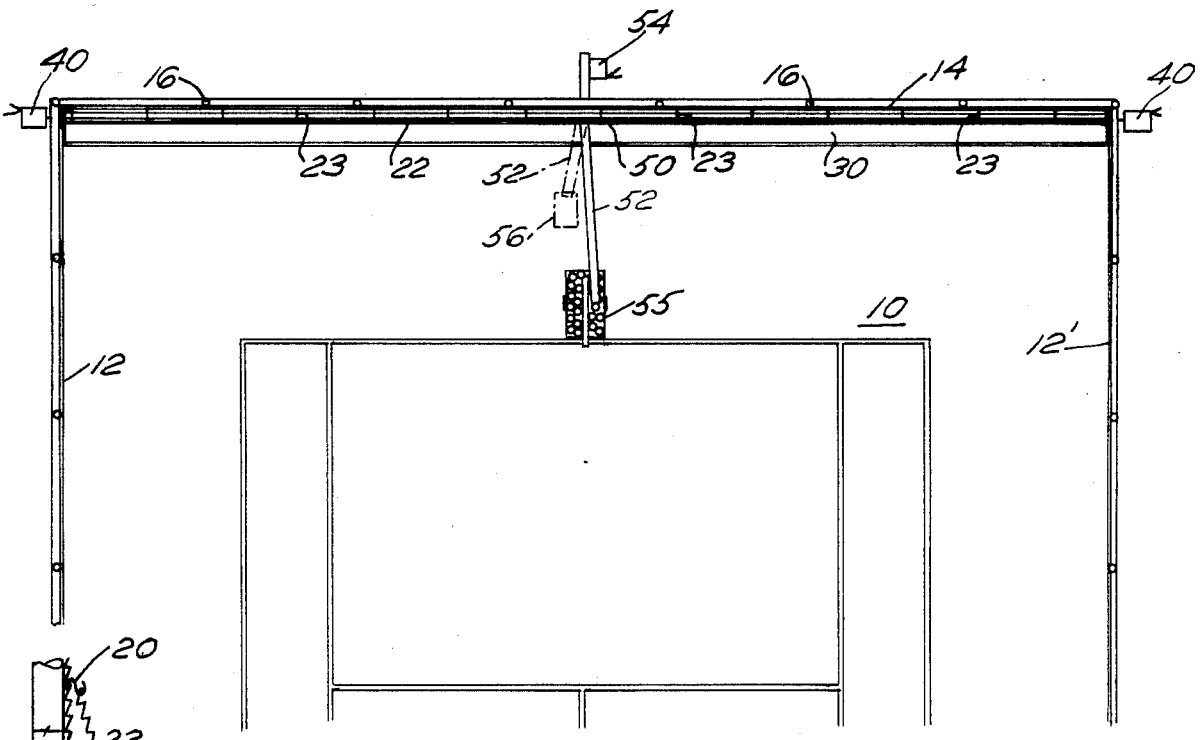
FIG. 1
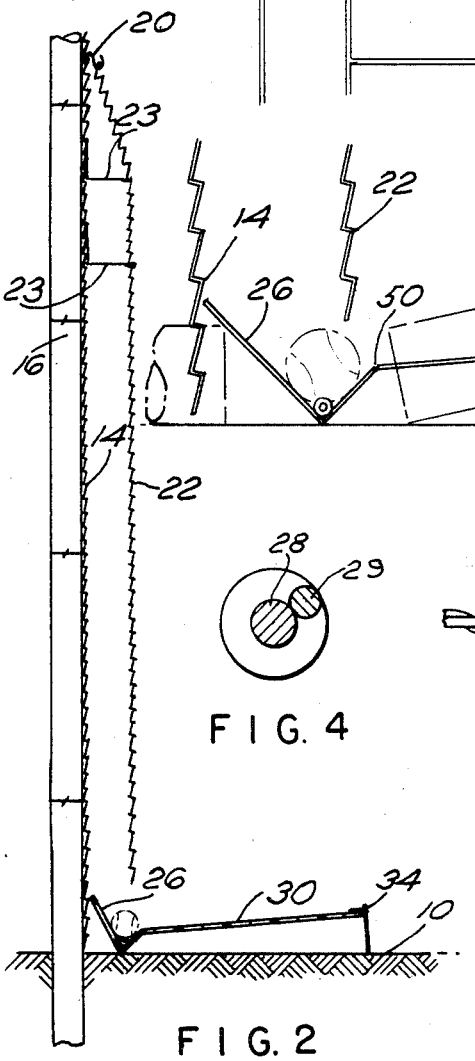
FIG. 2
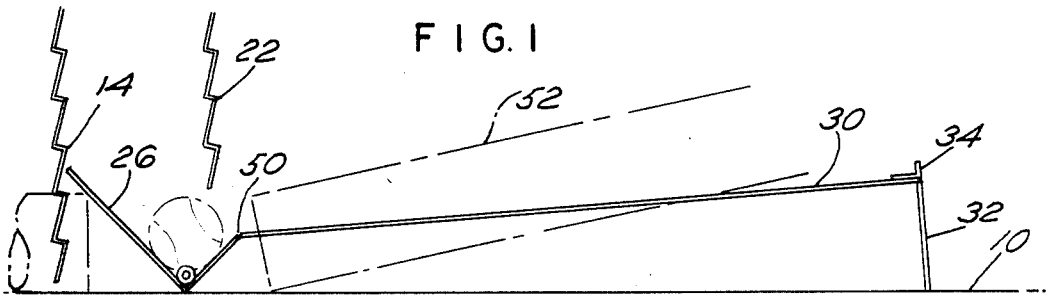
FIG. 3
FIG. 4
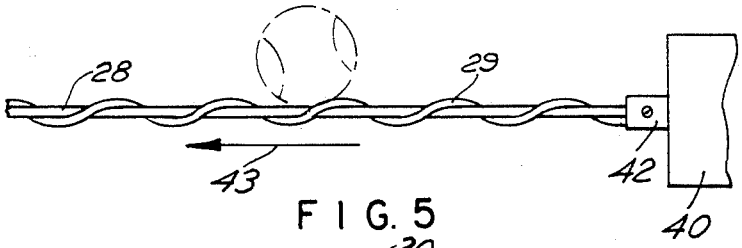
FIG. 5
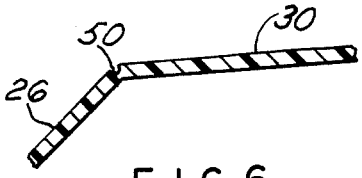
FIG. 6

TENNIS BALL RETRIEVING SYSTEM

BACKGROUND OF THE INVENTION

Tennis practice courts in the past have been essentially half courts which have been operated for the purpose of allowing an individual to practice without a partner. In some cases, full courts have been utilized; but in any of the systems that have used machines which drive balls to the tennis player, there has always been a problem in returning the balls to the machine. A standard form of a half court, for example, is seen in U.S. Pat. No. 4,025,071 where the balls are retrieved with a sloping ramp which requires special court construction. In many cases it is desirable to have a ball retrieving apparatus operating in a full tennis court, which can be used both for normal playing and for practice. This invention is therefore directed to a ball retrieving apparatus that operates in a full tennis court where a tennis player has the opportunity to develop his game and playing ability and to see where his balls actually land. With the present invention there are no ramps that need to be formed in a back court and the invention can be utilized without any structural modification to an existing tennis court.

SUMMARY OF THE INVENTION

This invention relates to the playing of tennis, and more specifically to the training of a tennis player and the recovery of tennis balls in full courts, the balls being recovered and delivered to an automated serving machine or to a recovery basket when lessons are conducted by a professional. The main feature of the invention is the efficient ball retrieval placed against the back wall or barrier of a full-sized tennis court. Against the back wall or barrier or fence is mounted in spaced relationship a flexible damping screen. Directly below the screen is located a trough and in front of the trough away from the screen is an apron, the apron being made out of resilient material, which apron is inclined toward the trough. A positive pressure device in the form of an air blower is located at a generally central station having an opening in the trough and apron, and a conduit located adjacent to the trough will pick up balls arriving at that station and direct them up the conduit to an automatic ball serving machine or basket. A feature of this invention is the use of chain link as the flexible damping screen, which functions in two ways: (1) The chain link damping screen affords a resilience which restricts the rebound of a ball moderately hit, having a norizontal or falling trajectory to the apron which is inclined slightly to enable the ball to roll into the trough; and (2) The flexible chain link damping screen, with square openings smaller than the size of a tennis ball, imparts to the hard hit ball, having a rising trajectory as it strikes the chain link, a backspin. Balls that strike the flexible chain link with a rising trajectory rebound from the loose chain link beyond the apron to the court surface. The backspin imparted by the chain link, due in part to the rising trajectory of the ball and the rough textured chain link is the reason why a ball landing beyond the apron returns to the apron on its first or second bounce. Helical feeder means operated by motors or other drives will direct the balls in the trough to the central opening where the conduit is located. One of the advantages to the instant invention is the length of time a player may practice in a court. With the ball machine shooting balls at the rate of twelve balls per minute, seventy-two balls will last six minutes. With the retrieving system of the instant invention, and assuming a retrieving rate of 80%, which has been proven in practice, seventy-two balls will last over twenty-five minutes. Further, the full-sized tennis court can be used at all times as the retrieving system can be left intact without inhibiting normal play. The only thing that has to be moved would be the ball machine or basket and a short length of conduit or tubing.

BRIEF DESCRIPTION OF THE DRAWINGS

FIG. 1 is a plan view of a portion of a tennis court showing the invention in place;

FIG. 2 is a sectional elevational view of the trough and apron;

FIG. 3 is an enlarged view showing the trough and apron with the positive air supply shown in dotted lines;

FIG. 4 is an enlarged view illustrating the helical drive for a tennis ball;

FIG. 5 is a sectional view through the helical drive means; and

FIG. 6 is an enlarged view of the hinge construction at the trough.

DETAILED DESCRIPTION OF THE PREFERRED EMBODIMENT

Referring now to the drawings, the tennis court which is either a full or half court, and preferably the former, has a flat rectangular surface 10 with a net stretched transversely thereof midway of a full court (not shown). For a single court, the single court would generally be enclosed by fencing such as fencing 12 and 12', which runs longitudinally of the court on either side thereof, and thence there will be a back barrier or fence 14 at either end of the court.

Referring now to FIG. 2, it may be noted that the fence 12 and 14 is conventionally made of a form of screening and supported on fence posts such as 16. In the instant arrangement, there is loosely hung on fence 14 by the use of S hooks 20, a damping screen 22 which is shown in the form of chain link fencing A five-inch space between the loose chain link fencing 22 and back fence 14 is created by the use of stand-offs 23 made of the same vinyl coated wire as used in the manufacture of the chain link. An important aspect of utilizing chain link fence is that it will hang in a vertical attitude and not be disturbed by wind. Further, it has been determined that when one uses chain link fence with square openings slightly smaller than the size of a tennis ball, in over 30% of the tennis balls striking the chain link damping screen 22, a backspin is imparted to the ball, which is due in part to the trajectory of the ball which normally bounds on the back court and onto the damping screen. When this happens, the backspin imparted to the ball as it falls downwardly insures that the ball strikes the apron.

Located beneath the damping screen is a retrieval trough 26 that runs from one side edge of the court to the other, and connected to the trough is an apron 30 which is inclined to the horizontal as seen in FIGS. 2 and 3 and which is supported at the end remote from the damping screen by a support leg 32, which may if desired, be continuous along the length of the apron 30. Also located at the forward edge of the apron 30 is a lip 34 which is attached thereto. The trough and the apron, as well as a support foot may all be made of one piece of molded plastic or a plurality of pieces of plastic of finite length, which are suitably vacuum formed. To this end it is desirable to vacuum form this assembly from polycarbonate as polycarbonate has great ultraviolet resistance, and in order to provide sufficient resiliency to the apron portion 30, it is desired that at least this portion have a thickness on the order of 0.125 inch (3.1 mm). By utilizing this thickness, resiliency is supplied on the apron of a sufficient amount so that when a tennis ball drops thereon, it will not bounce.

Located within the trough 26 is a helical drive mechanism consisting essentially of a central cable in the form of an airplane cable 28, that is a wire cable having a lay of 7×19. Around the periphery of this cable, a nylon cord 29, for example, is helically wound with a pitch of approximately 1.5 inch. The cable that has been found satisfactory is an 0.3125 inch aircraft cable with 0.25 inch nylon rope wound thereabout. This cable will adapt itself to portable use as it may be wound up into a large circle; and further, will lie within the trough with ease assuming the proper set.

Referring again to FIG. 4, a motor 40 having an output shaft 42 is clamped to the cable, and when the cable is rotated in the proper direction, a tennis ball as seen in phantom in the drawing, will move in the direction of the arrow 43. In FIG. 1 it will be seen that there are a pair of motors 40 and 40' that will drive two individual helical cables toward the central opening as at 50 in the trough, at which location a conduit 52 is placed which intercepts the trough and leads to a ball serving machine 55. To provide a positive air pressure, a blower 54 is provided which directs air across the trough picking up balls in the trough and inserting them into the conduit 50 where they will land in the hopper of the ball serving machine 55. Alternatively, the conduit 52 may deliver the balls to a receptacle or basket 56 (seen in broken lines) which arrangement is utilized in a professional teaching situation so that the instructor need not take time retrieving balls.

in some cases it is desirable to move the apron out of the way when the tennis court is being used in a normal fashion, as some players object to any obstructions that are in the back court. To this end, the joint between the apron and the trough may be formed with a longitudinal depression 50 which serves as a hinge point for the apron relative to the trough. It should also be understood that the trough in this instance must be fastened to the back fence by suitable wire clips so that when the apron 30 is lifted to lie against the screen 22 and back fence 20, the trough will not be moved out of position. As will be readily understood, a simple fastener may be provided to hold the apron in the vertical position against the screen 22.

I claim:

1. A tennis ball recovery system for a tennis playing court having a back fence comprising:

a substantially inelastic flexible damping screen, said screen being mounted such that a portion thereof is in spaced relation to and substantially parallel to the back fence of a tennis court, a horizontal trough having its length substantially parallel with and positioned below the bottom edge of the damping screen;

said trough having an opening;

a ball receptacle;

a conduit at the opening directed away from the back fence to said receptacle;

positive pressure means arranged to direct air transversely across the trough and through said conduit to feed balls into the conduit;

an airplane cable having a cord wound helically thereabout forming a helical feed screw and means to rotate the cable whereby balls are moved toward the opening.

2. A tennis ball recovery system as in claim 1 wherein the damping screen hangs free at its lower edge and is chain link fencing material having square openings smaller than a tennis ball.

3. A tennis ball recovery system as in claim 1 wherein a resilient apron extends from the trough away from the damping screen, said apron being formed of polycarbonate of thickness on the order of 3.1 mm.

* * * * *